US009764368B2

(12) United States Patent
Haverkamp et al.

(10) Patent No.: US 9,764,368 B2
(45) Date of Patent: Sep. 19, 2017

(54) ROLLING MILL AND ROLLING METHOD

(71) Applicant: SMS group GmbH, Duesseldorf (DE)

(72) Inventors: Mark Haverkamp, Duesseldorf (DE); Norbert Theelen, Erkelenz (DE)

(73) Assignee: SMS group GmbH, Duesseldorf (DE)

( * ) Notice: Subject to any disclaimer, the term of this patent is extended or adjusted under 35 U.S.C. 154(b) by 11 days.

(21) Appl. No.: 14/346,393

(22) PCT Filed: Sep. 24, 2012

(86) PCT No.: PCT/DE2012/000938
§ 371 (c)(1),
(2) Date: Apr. 4, 2014

(87) PCT Pub. No.: WO2013/041084
PCT Pub. Date: Mar. 28, 2013

(65) Prior Publication Data

US 2014/0230509 A1 Aug. 21, 2014

(30) Foreign Application Priority Data

Sep. 23, 2011 (DE) ..... 10 2011 114 143

(51) Int. Cl.
*B21B 38/10* (2006.01)

(52) U.S. Cl.
CPC ..... *B21B 38/10* (2013.01); *B21B 38/105* (2013.01)

(58) Field of Classification Search
CPC ..... B21L 38/10; B21L 38/105; B21D 38/10; B21D 38/105; B21B 31/16; B21B 37/58
See application file for complete search history.

(56) References Cited

U.S. PATENT DOCUMENTS 3,850,015 A 11/1974 Andresen
3,906,767 A * 9/1975 Tanaka ..... B21B 38/10 72/10.6

(Continued)

FOREIGN PATENT DOCUMENTS

DE 22 24 833 A1 11/1973
DE 26 46 328 A1 4/1978

(Continued)

OTHER PUBLICATIONS

International Search Report of PCT/DE2012/000938, mailed Dec. 9, 2013.

*Primary Examiner* — Debra Sullivan
(74) *Attorney, Agent, or Firm* — Collard & Roe, P.C.

(57) ABSTRACT

Disclosed is a rolling mill, in particular a rolling mill having more than one mill stand, comprising at least two rolls (30) which are mounted in a roll bearing in a mill stand to absorb rolling forces, further comprising means (40) for moving at least one roll relative to the mill stand as well as means (50) for determining the roll pass, the determining means having a pass reference (54) and a spatial reference (56) as well as means (58) for measuring the relative position between the pass reference and the spatial reference. In order to create a rolling mill that provides as accurate information as possible about the roll pass, the pass reference and/or the spatial reference is/are arranged peripherally in relation to the power flow occurring between the roll and the mill stand.

17 Claims, 8 Drawing Sheets

(56) References Cited

U.S. PATENT DOCUMENTS

Figure 1:
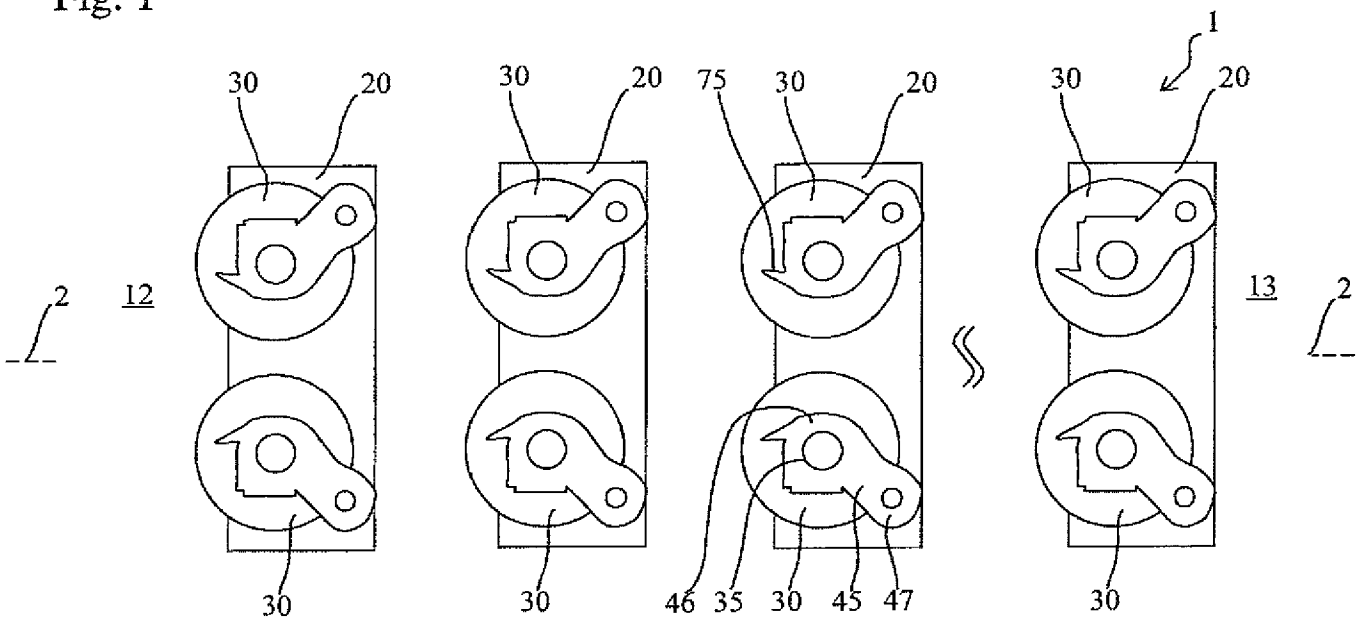

| | | | | |
|---|---|---|---|---|
| 5,775,154 | A * | 7/1998 | Haberkamm | B21B 37/28 72/13.4 |
| 7,174,758 | B2 * | 2/2007 | Tauber | B21B 38/10 72/10.6 |
| 2010/0281969 | A1 | 11/2010 | Seidel et al. | |

FOREIGN PATENT DOCUMENTS

| | | | |
|---|---|---|---|
| DE | 102 02 526 | A1 | 7/2003 |
| DE | 10 2007 048 686 | A1 | 4/2009 |
| DE | 10 2008 037 756 | A1 | 2/2010 |
| GB | 1 586 807 | A | 3/1981 |

* cited by examiner

ROLLING MILL AND ROLLING METHOD

CROSS REFERENCE TO RELATED APPLICATIONS

This application is the National Stage of PCT/DE2012/000938 filed on Sep. 24, 2012 which claims priority under 35 U.S.C. §119 of German Application No. 10 2011 114 143.3 filed on Sep. 23, 2011, the disclosure of which is incorporated by reference. The international application under PCT article 21(2) was not published in English.

The invention relates to a rolling mill, particularly to a multi-stand rolling mill, having at least two rolls mounted in a roll stand, in a roll bearing, to absorb rolling forces, having means for displacement of at least one roll with reference to the roll stand, and having means for determining the roll pass, wherein the determination means have a pass reference and a spatial reference, as well as means for measuring the relative position, between the pass reference and the spatial reference. Likewise, the invention relates to a rolling method in which rolls are positioned on-line, to a desired roll pass, taking into consideration measurement results of means for determining a roll pass.

Such rolling mills and rolling methods are actually known, whereby the means for determining the roll pass are disposed in positioning cylinders with which the rolls can be positioned, and determine the roll pass, in each instance, by way of the cylinder position or by way of the position of the corresponding piston. In this connection, the determination regularly takes place by way of a spatial reference, which is assumed, by definition, to be fixed in space, and by way of a pass reference, the position of which serves as a measure for the position of the corresponding roll and thereby as a measure for the roll pass.

It is the task of the present invention to make available a rolling mill of the stated type and a rolling method of the stated type, which allow the most precise information possible concerning the roll pass.

As a solution, rolling mills and rolling methods having the characteristics of the independent claims are proposed, which actually allow providing information about the roll pass during rolling, in some cases. Further advantageous embodiments are found in the dependent claim and the following description.

Thus, a rolling mill of the stated type can be characterized in that the pass reference and/or the spatial reference is/are disposed peripheral to the force flow, with reference to a force flow that occurs between roll and roll stand. In this way, distortions of the measurement results, in each instance, caused by rolling forces, can be minimized, and correspondingly, the most precise information possible concerning the roll pass can be maximized. This particularly holds true also in comparison with the known rolling mills, in which pass reference and spatial reference are disposed, in each instance, in the cylinder that is put under pressure to apply the rolling forces. Accordingly, of course, force-related influences must be expected.

It is particularly advantageous if the spatial reference is disposed outside of a force introduction region in which the rolling forces are introduced into the roll stand. In this way, the influence of stresses caused by the rolling forces can be minimized. Furthermore, it has turned out that in this way, maintenance problems can also be minimized, because corresponding regions are frequently more easily accessible. Preferably, the spatial reference is disposed outside of the force introduction region of the roll that is being measured at a specific time. In particular, it is accordingly advantageous if each spatial reference is disposed outside of a force introduction region in which rolling forces are introduced into the roll stand. In this manner, a spatial reference that is as locally fixed as possible can be made available, so that the corresponding measurement results are not or only minimally impaired.

It is also possible to dispose the spatial reference, and preferably every spatial reference of at least one roll stand, on the roll stand in the vicinity of a neutral region of the roll stand, between two force introduction regions in which rolling forces are introduced into the roll stand. In this way, as well, the influence of roll stresses or forces can be minimized.

In this connection, it should be explained that the term "in the vicinity" in the present connection means that the spatial reference is disposed at a distance from the neutral region of twice the minimal thickness of the roll stand or less, or twice the minimal radial thickness of or less. Naturally, a neutral region is subject to relatively little stress, so that accordingly, a change in stresses caused by the rolling forces can also exert less of an influence. In this connection, the "thickness of the roll stand" in the present connection is defined as the thickness of the roll stand parallel to the pass line or in the direction of the pass line of the rolling mill, while the "radial thickness" is defined as the thickness of the roll stand radially or perpendicular to the pass line. Both variables, particularly in their minimum value, represent a relatively reliable and practically reproducible measure for the important dimensioning present in the roll stand, in each instance, with regard to the force distribution.

A pass reference disposed peripheral to the force flow can be implemented in particularly simple and operationally reliable manner if the pass reference is disposed on a projection free of rolling forces. The projection then follows the corresponding movement of the body on which the projection free of rolling forces is disposed, without being subject to possible stresses or moments. In this connection, it is advantageous to dispose this projection free of rolling forces as closely as possible in the vicinity of the roll, for example on a rocker that carries the roll by way of a bearing, or on a non-rotating module of the bearing itself.

In order to minimize measurement errors caused by roll stresses or rolling forces, and therefore advantageously with regard to the most precise information possible concerning the roll pass, the pass reference can be disposed at a distance from the roll bearing of less than one bearing diameter of the roll bearing. This is accordingly advantageous even independent of the other characteristics, in the case of rolling mills of the stated type. In this way, it is ensured that the pass reference is disposed as closely as possible to the roll itself.

Likewise, the closest possible placement of the pass reference to the roll can be implemented if at least one of the rolls is mounted in a bearing body and the pass reference is disposed on the bearing body. In this way, too, fewer measurement errors occur as the result of roll stresses or rolling forces, so that accordingly, the most precise information possible concerning the roll pass is made possible. It is understood that placement of the pass reference on the bearing body is advantageous even independent of the other characteristics of the present invention, in the case of a rolling mill of the stated type.

Preferably, the bearing body has a rocker having a bearing side that serves as the bearing body, on which side a displacement means for displacement of the roll, in each instance, such as, for example, the piston or the cylinder of a piston/cylinder unit, acts, and having a guide side, whereby the pass reference is provided on the side of the bearing side facing away from the guide side. Such an arrangement lies peripheral to the force flow, so that accordingly, measurement errors are minimized. It is understood that other displacement means, such as electromechanical displacement means, if applicable with a hydraulic fixation element, for example, can also be used in place of piston/cylinder units.

The measurement means can comprise a distance measurement device that measures the distance between pass reference and spatial reference. In this manner, a conclusion can be drawn concerning the roll pass, in simple and reliable manner, from the distance between pass reference and spatial reference, because for this purpose, only corresponding geometrical conversions are required. If applicable, however, a calibration step can be undertaken before rolling, during which step the changes in the measurement result of the measurement means are recorded in calibrating manner, as a function of the roll position.

Preferably, the distance measurement device is configured to be tactile or to make contact, so that it yields measurement results in cost-advantageous and precise manner, particularly even in the presence of dust and steam.

Also, a rolling mill of the stated type can be characterized in that the spatial reference is disposed separate from the roll stand. In this way, it is ensured, in every case, that the spatial reference is independent or roll stresses or rolling forces, whereby if applicable, maintenance problems due to difficult accessibility or due to affixing of the measurement means on the spatial reference or on the pass reference must be accepted, if the roll stand or, alternately, only the pass reference and the module that carries the pass reference are supposed to be removed for maintenance work or re-fitting work and brought back into the rolling mill. On the other hand, in this manner the most precise information possible concerning the roll pass can be ensured.

The determination means or the measurement means can be calibrated by means of off-line calibration means that allow a measurement of the roll pass directly on at least one roll. This then makes it possible to predict the reaction of the roll, in each instance, if the rolls are acted on by way of the displacement means, in accordance with the measurement results of the measurement means or determination means.

Preferably, the rolling mill has a regulation circuit for regulating the roll pass, which circuit comprises the determination means, and input means for measurement results of the calibration means as a guide variable of the regulation circuit, as a correction variable for the setting variable of the regulation circuit and/or as a correction variable for the determination means or the displacement means. In this manner, the measurement results that result from the calibration by means of the off-line calibration means can be introduced into the regulation circuit. In this connection, there are various possibilities for using these measurement results in a practical manner. Ultimately, what is most advantageous here depends on the concrete conditions, in each instance. Thus, these measurement results can serve merely for a correction of the measurement results of the determination means or measurement means. Likewise, a correction of the setting variable or a correction of the action on the displacement means or on their own control circuit can take place.

More precise information concerning the roll pass can be confirmed by means of an off-line calibration of the determination means before rolling. It is understood that this can be used accordingly advantageously even independent of the other characteristics of the present invention, in the case of a rolling method of the stated type.

In this connection, it is understood that such a calibration does not have to take place every time before every rolling process. Instead, such a calibration can be undertaken in the case of more extensive re-fitting work, for example, or in the case of maintenance work.

In this connection, it should be explained that the term "off-line" specifically relates to work, activities or devices that are only used when no rolling is taking place in the rolling mill.

Preferably, the off-line calibration takes place in-line, in other words when the rolls, in each instance, or the related roll stands are disposed in the rolling segment. Accordingly, it is also advantageous if the off-line calibration means are disposed or can be disposed directly on the rolling mill, in order to be able to measure the rolls in-line.

On the other hand, it is also possible to carry out out-line measurements, in order to measure the roll pass directly.

Preferably, for off-line calibration, the position of the rolls is measured directly, in order to be able to calibrate the measurement means or determination means as precisely as possible in this manner.

Positioning of the rolls can take place within a regulation circuit for taking the measurement results of the determination means into consideration, so that the rolls are positioned as optimally as possible in each instance. If applicable, the regulation circuit can also use measurement results from work piece measurements downstream from the rolling mill, such as, for example, pipe wall thickness measurements or cross-sectional measurements, as a regulation variable.

In the present connection, the term "roll stand" refers to any structural unit that applies and compensates the forces that occur during rolling and are required for rolling deformation. In this regard, a roll stand can be provided and designed as a frame and structurally movable unit for rapid changing processes, but this is not absolutely necessary. Instead, the roll stand can also be connected with the rest of the rolling mill in relatively rigid manner, so that changing processes, such as, for example, replacement of rolls or other wear parts, require greater installation activities.

It is understood that the characteristics of the solutions described above and in the claims can also be combined, if applicable, in order to be able to implement the advantages accordingly cumulatively.

Figure 2:
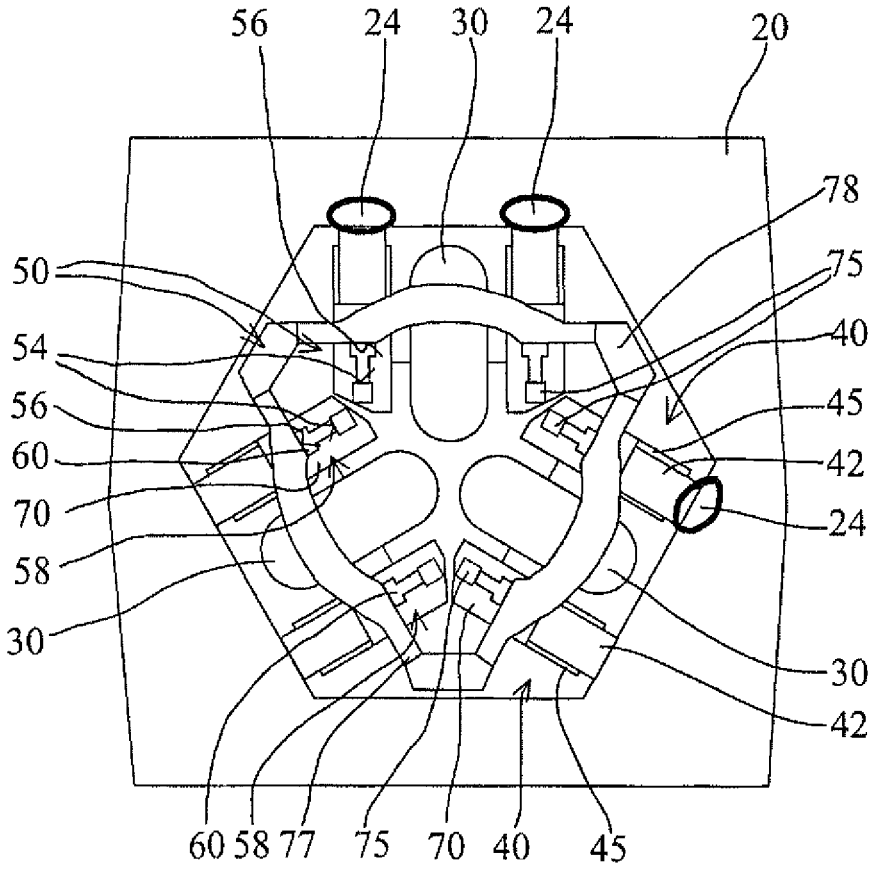
Figure 3:
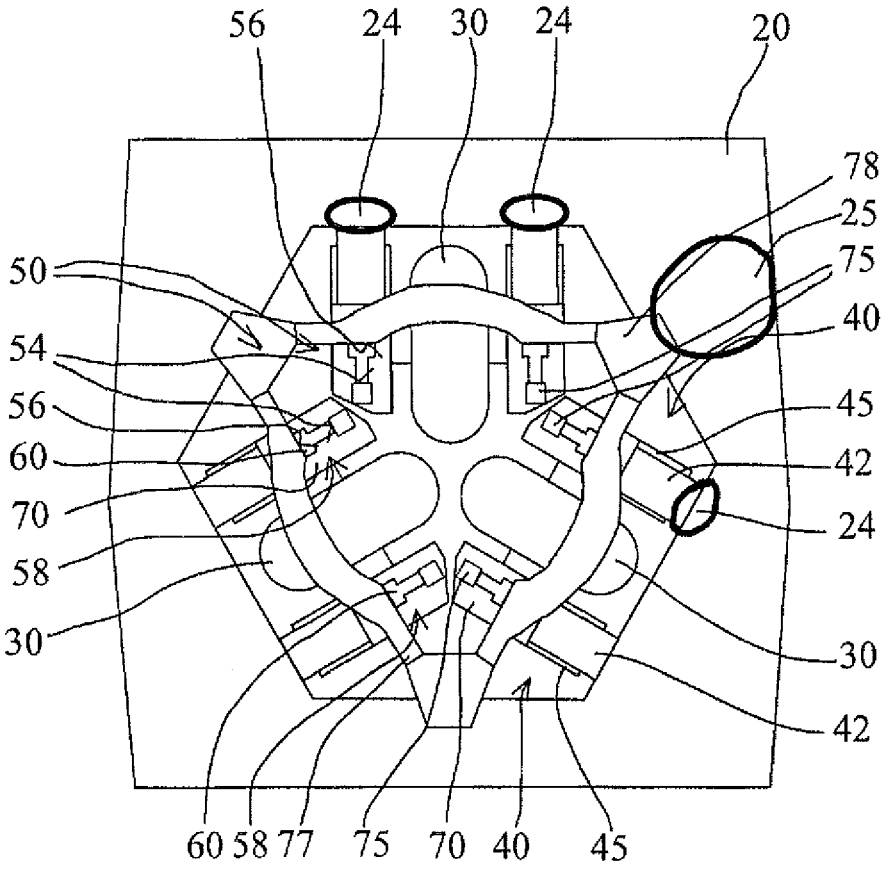
Figure 4:
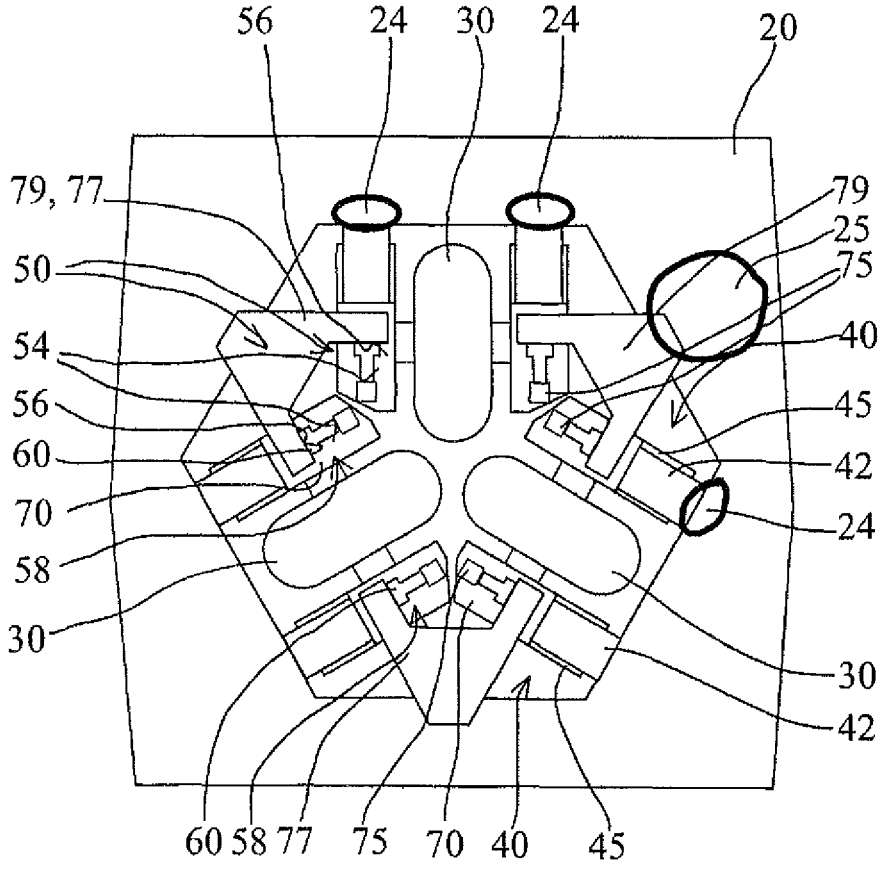
Figure 5:
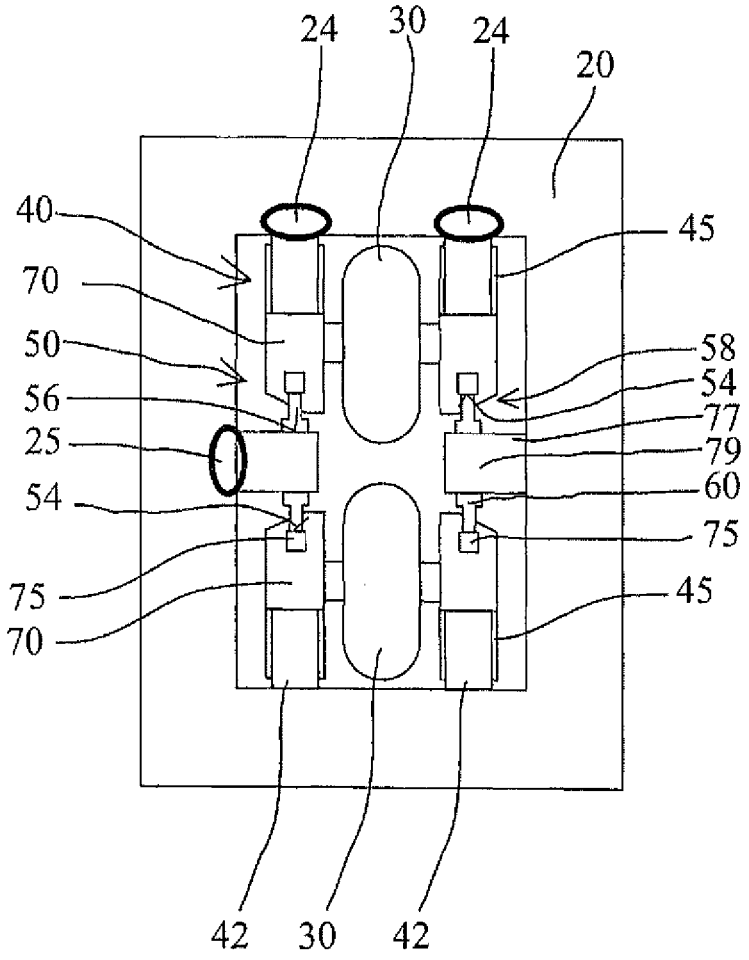
Figure 6:
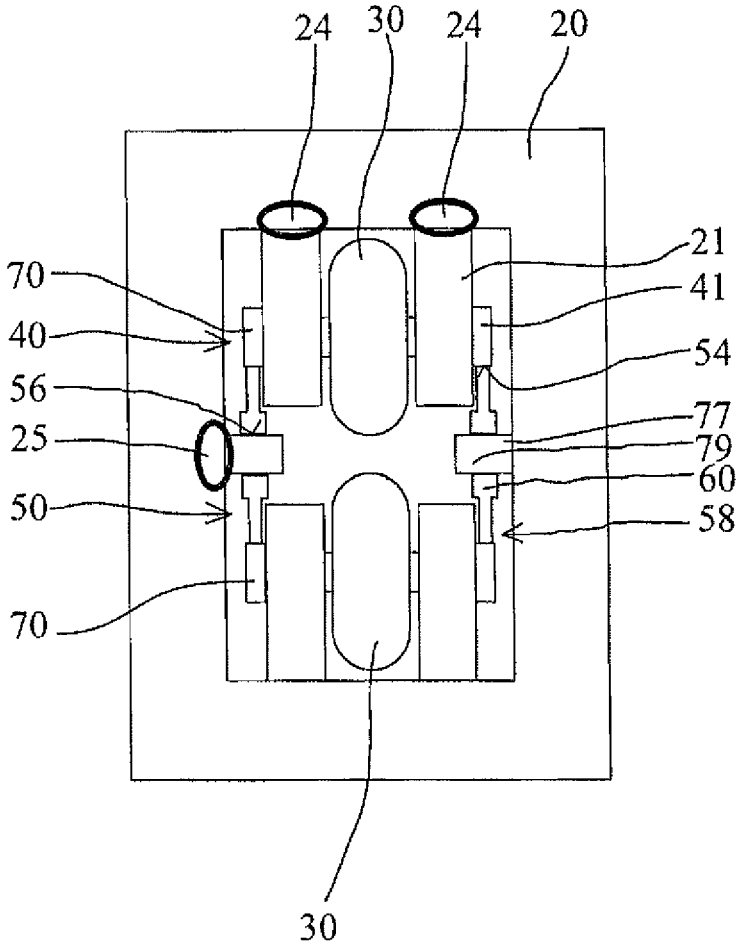
Figure 7:
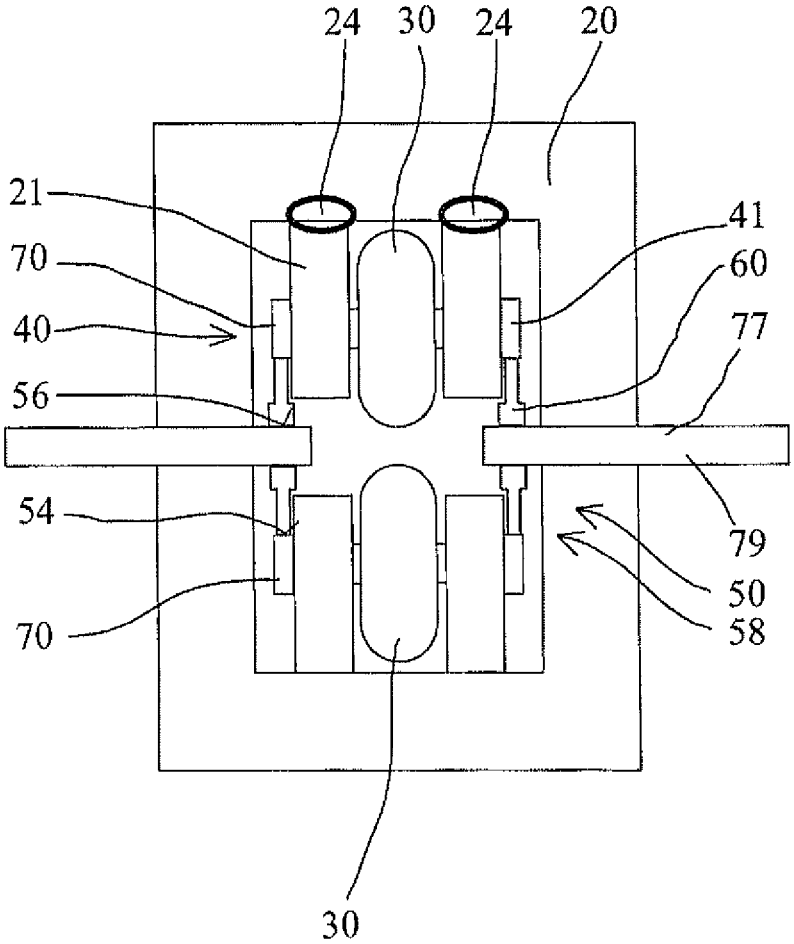
Figure 8:
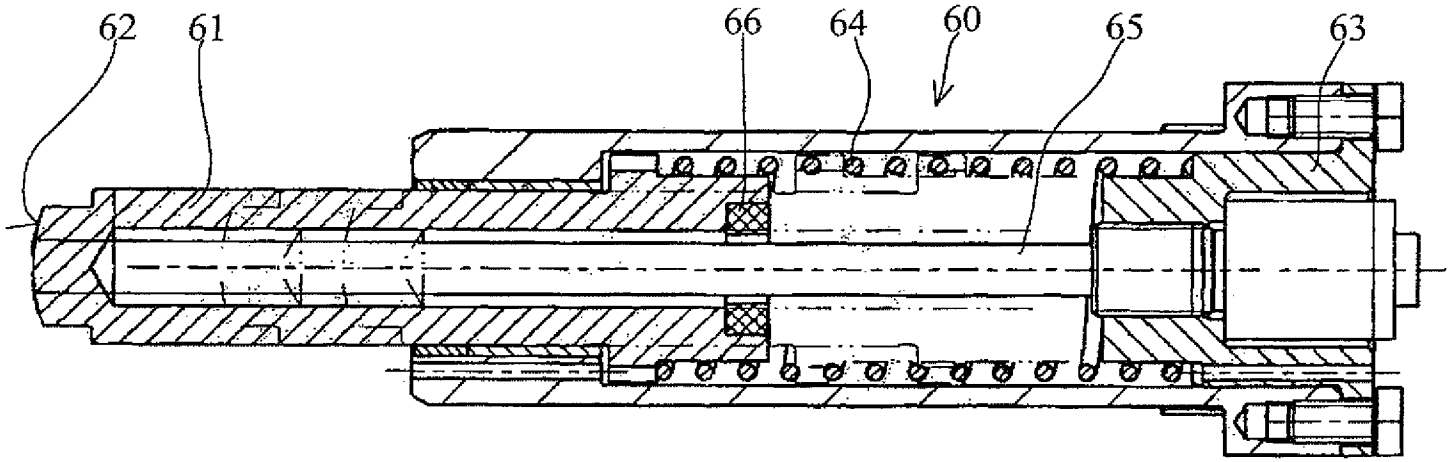

Further advantages, aims, and properties of the present invention will be explained using the following description of exemplary embodiments, which are particularly shown also in the attached drawing. The drawing shows:

FIG. 1 a schematic side view of a rolling mill;

FIG. 2 a schematic front view of a roll stand that can be used in the rolling mill according to FIG. 1, having a reference support attached independent of a roll stand;

FIG. 3 a schematic front view of a further roll stand that can be used in the rolling mill according to FIG. 1, having a reference support attached on the roll stand in neutral regions of the roll stand;

FIG. 4 a schematic front view of a further roll stand that can be used in the rolling mill according to FIG. 1, having reference supports attached on the roll stand in neutral regions of the roll stand;

FIG. 5 a schematic front view of a further roll stand that can be used in the rolling mill according to FIG. 1, having reference supports attached on the roll stand in neutral regions of the roll stand;

FIG. 6 a schematic front view of a further roll stand that can be used in the rolling mill according to FIG. 1, having reference supports attached on the roll stand in neutral regions of the roll stand, and eccentric bushings for positioning of the rolls;

FIG. 7 a schematic front view of a further roll stand that can be used in the rolling mill according to FIG. 1, having reference supports attached independent of the roll stand, and eccentric bushings for positioning of the rolls; and FIG. 8 a section through a distance measurement device, in which the measurement electronics, in particular, have been removed, and therefore can be disposed outside of an area subject to a high temperature and/or great mechanical stress.

The rolling mill 1 shown schematically in FIG. 1 comprises a plurality of roll stands 20 each having rolls 30 mounted on the roll stands 20. The roll stands 20 are aligned along a pass line 2, so that a work piece can pass through the rolls 30 along the pass line 2, from an input side 12 to an output side 13.

The space situated between the rolls 30, in each instance, is referred to as the roll pass and is therefore a measure of the extent to which the rolls 30 act on the work piece, in each instance.

It is directly comprehensible that precise knowledge of the roll pass, in each instance, allows influencing the rolling process in advantageous manner.

The rolls 30 of the exemplary embodiment concretely shown in FIG. 1 are mounted in rockers 45 as bearing bodies 70, whereby the bearing body 70 is configured in a bearing side 46 of the rockers 45.

The rockers 45 furthermore have a guide side 47 that ultimately defines the movement possibilities of the rocker 45, in that this side guides the rocker 45, in each instance.

For this purpose, the bearing side 46 and the bearing body 70 have a roll bearing 35, which bears the roll 30, in each instance.

A projection 75 free of rolling forces is disposed on the side of the bearing side 46 facing away from the guide side 47, which projection can be used as a pass reference 54, as will be explained in detail below, using the further exemplary embodiments. As is directly evident, this projection 75 free of rolling forces and therefore the pass reference 54 are disposed away from the roll bearing 35 by less than the bearing diameter of the roll bearing 35. Also, it is directly comprehensible that the pass reference 54 or the projection 75 free of rolling forces is disposed peripheral to the force flow with reference to a force flow that occurs between the roll 30, in each instance, and the roll stand 20. In this connection, it must be taken into consideration that on the bearing side 46, facing away from the pass, a piston/cylinder unit 42 can apply force to the rolls, in each instance, in the direction toward the pass or the pass line 2, as is explained as an example in FIGS. 2 to 5. As can be seen from FIG. 1, the corresponding contact surface on which the piston/cylinder unit 42 can engage is disposed far removed from the projection 75 free of rolling forces or the related pass reference 54, so that the latter can be found peripheral to the force flow. In deviating embodiments, other displacement means 40, such as electromechanical displacement means, for example, if applicable having a hydraulic fixation element, can also be used in place of the piston/cylinder units 42.

In the exemplary embodiment shown in FIG. 2, three rolls 30 are disposed on the roll stand 20 and are mounted so that they can be positioned by way of rockers, whereby the positioning takes place by means of the piston/cylinder units 42, which support themselves on the rockers 45, on the one hand, and on the roll stand 20, on the other hand, and in turn absorb the rolling forces and serve for pass positioning.

Force introduction regions 24, in which the supporting force and therefore the rolling force is introduced into roll stand 20, lie, in each instance, where the piston/cylinder units 42 support themselves on the roll stand 20, in each instance, as displacement means 40 that displace the rolls 30.

Each of the rockers 45 has a projection 75 free of rolling forces, as was already explained with regard to FIG. 1.

Distance measurement devices 60 are disposed on the projections 75 free of rolling forces, in each instance, which devices support themselves on a support ring 78 that forms the spatial reference support 77.

With regard to each distance measurement device 60, a pass reference 54 is disposed on every projection 75 free of rolling forces, and a spatial reference 56 is disposed on the spatial reference support 77, which references, together with the measurement means 58 embodied by the distance measurement devices 60, form means 50 for determining the roll pass.

In the exemplary embodiment shown in FIG. 2, the support ring 78 or the spatial reference support 77 is attached independent of the roll stand 20, so that the spatial references 56 are disposed separate from the roll stand 20.

The exemplary embodiment shown in FIG. 3 corresponds, in essential parts, to the exemplary embodiments according to FIGS. 1 and 2, so that no renewed description of all the details will be presented here. However, in the exemplary embodiment shown in FIG. 3, the support ring 78 is attached to the roll stand 20, but this takes place in neutral regions 25, which can be found, in each instance, between two force introduction regions 24. In this manner, stresses that could be conducted into the spatial reference support 77 and could lead to displacement of the spatial references 56 can be reduced to a minimum. If necessary, a movable attachment, which therefore equalizes displacements, of the support ring 78 on the roll stand 20 can be provided.

As is directly comprehensible, the spatial reference 46 is disposed outside of a force introduction region, in each instance, in which the rolling forces are introduced into the roll stand 20, in this arrangement as well.

The arrangement shown in FIG. 4 essentially corresponds to the arrangement according to FIG. 3, whereby here, however, a support ring 78 as a spatial reference support 77 is not provided. Instead, individual support arms 79 are disposed in neutral regions 25 of the roll stand 20, in each instance, which arms serve as spatial reference supports 77. Such an arrangement already leads to the result that the spatial references 56 are disposed outside of the force introduction region 24 and thereby peripheral to the force flow.

In the exemplary embodiment shown in FIG. 5, as well, extensions situated on the roll stand 20, which are set on in neutral regions 25 and project into the interior of the roll stand 20, serve as support arms 79. Depending on the concrete embodiment, the support arms 79 can also be configured in one piece with the roll stand 20.

Furthermore, the roll stand 20 according to FIG. 5 is merely a two-roll stand, while the arrangements according to FIGS. 2 to 4 are three-roll stands, in each instance. It is understood that in deviating embodiments, roll stands 20 having four and more rolls can also easily be used accordingly. For the remainder, the exemplary embodiment according to FIG. 5 does not differ further from the exemplary embodiment shown in FIG. 4, so that no repetition to explain modules having the same effect will be given here.

The arrangement shown in FIG. 6 essentially corresponds to the arrangement according to FIG. 5, whereby in the exemplary embodiment shown in FIG. 6, eccentric bushings 41 are used as displacement means 40, and surface areas of the eccentric bushings 41, which are displaced coaxial to the axis of the roll, along with it, are used as the pass reference 54.

The eccentric bushings 41 are disposed on stand arms 21, which in turn are firmly attached to the roll stand 20, whereby accordingly, force introduction regions 24 into the roll stand 20 can be found in the area of this attachment. Depending on the concrete implementation of this exemplary embodiment, the stand arms 21 can also be configured in one piece with the roll stand.

In the exemplary embodiment shown in FIG. 7, which corresponds, in most parts, to the exemplary embodiment according to FIG. 6, the spatial reference support 77 or the support arms 79 are disposed independent of the rolls stand 20, as was already explained, as an example, using the exemplary embodiment shown in FIG. 2, so that the spatial references 56 remain uninfluenced by any rolling forces.

The arrangement according to FIG. 8, for example, can be used as a distance measurement device 60, in which a measurement tip 61 is provided, having a measurement contour 62 adapted to the movement of the references 54, 56, a measurement foot 63 that lies opposite this measurement contour 62 or the measurement tip 61, and a spring 64 that maintains the distance between the measurement tip 61 and the measurement foot 63, and in which the measurement electronics, in particular, can be disposed spatially removed and thereby outside of an area subject to a high temperature and/or great mechanical stress, as this can generally be found in the vicinity of the roll during rolling.

For this purpose, the distance measurement device 60 according to FIG. 8 has a waveguide 65 that can measure the distance between measurement tip 61 and measurement foot 63, in each instance, interacting with a magnet 66, whereby the actual evaluation of the measurement result determined by way of the waveguide 65 can then take place far outside.

The distance measurement device 60 is affixed, with its measurement foot 63, either on the pass reference 54 or on the spatial reference 56, for example, so that the measurement tip 61 sits on the related counter-piece of this pass reference 54 or of the spatial reference 56, in each instance.

REFERENCE SYMBOL LIST

1 rolling mill
2 pass line
12 input side
13 output side
20 roll stand
21 stand arm (numbered as an example)
24 force introduction region (represented as an example)
25 neutral region (represented as an example)
30 roll
35 roll bearing
40 displacement means (numbered as an example)
41 eccentric bushing
42 piston/cylinder unit (numbered as an example)
45 rocker (numbered as an example)
46 bearing side (numbered as an example)
47 guide side (numbered as an example)
50 determination means (numbered as an example)
54 pass reference (numbered as an example)
56 spatial reference (numbered as an example)
58 measurement means (numbered as an example)
60 distance measurement device (numbered as an example)
66 measurement tip
62 measurement contour adapted to the references 54, 56
63 measurement foot
64 distance-maintaining spring
65 waveguide for measurement
66 magnet
70 bearing body
75 projection free of rolling force
77 spatial reference support
78 support ring
79 support arm

The invention claimed is:

1. A rolling mill comprising:
a roll stand,
a first roll mounted in the roll stand in a first roll bearing,
a second roll mounted in the roll stand in a second roll bearing, said roll stand absorbing rolling forces via said first and second roll bearings and said first and second rolls,
a displacement device configured to displace at least the first roll with reference to the roll stand,
a spatial reference support attached independent of the roll stand or attached to the roll stand, and
a determining device for determining the roll pass,
wherein the determining device comprises:
a pass reference,
a locally fixed spatial reference locally fixed to the spatial reference support, and
a measuring device for measuring the relative position between the pass reference and the locally fixed spatial reference with contact, and
wherein the pass reference is disposed at a distance from the first roll bearing of less than one bearing diameter of the first roll bearing.

2. The rolling mill according to claim 1, wherein the pass reference and/or the locally fixed spatial reference is/are disposed peripheral to the force flow, with reference to a force flow that occurs between the roll and the roll stand.

3. The rolling mill according to claim 2, wherein the locally fixed spatial reference is disposed outside of a force introduction region in which the rolling forces are introduced into the roll stand.

4. The rolling mill according to claim 3, further comprising a plurality of determining devices for determining the roll pass,
wherein each determining device comprises a respective spatial reference,
wherein each spatial reference is disposed outside of a force introduction region in which the rolling forces are introduced into the roll stand.

5. The rolling mill according to claim 2, wherein the locally fixed spatial reference is disposed on the roll stand in a vicinity of a neutral region of the roll stand, between two force introduction regions in which the rolling forces are introduced into the roll stand.

6. The rolling mill according to claim 2, wherein the pass reference is disposed on a projection free of rolling forces.

7. The rolling mill according to claim 1, wherein at least one of the first and second rolls is mounted in a bearing body and the pass reference is disposed on the bearing body.

8. The rolling mill according to claim 7, wherein the bearing body has a rocker having a bearing side that serves as the bearing body, wherein the displacement device acts on the bearing side, wherein the rocker has a guide side, and wherein the pass reference is provided on the side of the bearing side facing away from the guide side.

9. The rolling mill according to claim 1, wherein the measurement device comprises a distance measurement device that measures the distance between the pass reference and the locally fixed spatial reference.

10. The rolling mill according to claim 1, wherein the locally fixed spatial reference is disposed separate from the roll stand.

11. The rolling mill according to claim 1, further comprising an off-line calibration device that allows a measurement of the roll pass directly on at least one roll.

12. The rolling mill according to claim 11, further comprising a regulation circuit for regulating the roll pass, which regulation circuit comprises the determining device, and further comprising an input device for measurement results of the off-line calibration device as a guide variable of the regulation circuit, as a correction variable for the setting variable of the regulation circuit and/or as a correction variable for the determining device or the displacement device.

13. The rolling mill according to claim 1, wherein the spatial reference support is not movably attached.

14. The rolling mill according to claim 1, wherein the measuring device comprises a measurement foot;

wherein the measurement foot comprises a measurement tip; and wherein the measurement foot is disposed either on the pass reference or on the locally fixed spatial reference such that the measurement tip sits on a related counterpiece of the pass reference or of the locally fixed spatial reference.

15. A method for positioning rolls, the method comprising steps of:

providing a rolling mill comprising:

a roll stand, a first roll mounted in the roll stand in a first roll bearing, a second roll mounted in the roll stand in a second roll bearing, a displacement device configured to displace at least the first roll with reference to the roll stand, a spatial reference support attached independent of the roll stand or attached to the roll stand, and a determining device for determining a roll pass, wherein the determining device comprises:

a pass reference, a locally fixed spatial reference locally fixed to the spatial reference support, and a measuring device for measuring the relative position between the pass reference and the locally fixed spatial reference with contact, and wherein the pass reference is disposed at a distance from the first roll bearing of less than one bearing diameter of the first roll bearing;

calibrating the determining device off-line;

determining a roll pass via the determining device measuring the relative position between the pass reference and the locally fixed spatial reference with contact;

positioning on-line the first roll and the second roll to a desired roll pass, taking into consideration the roll pass determined via the determining device; and absorbing rolling forces of the first and second rolls via the first and second roll bearings and via the roll stand.

16. Rolling method according to claim 15, wherein the position of the rolls is measured directly for off-line calibration.

17. Rolling method according to claim 15, wherein positioning of the rolls takes place within a regulation circuit, taking measurement results of the determining device into consideration.

* * * * *